US006375511B1

(12) United States Patent
Yu

(10) Patent No.: US 6,375,511 B1
(45) Date of Patent: Apr. 23, 2002

(54) ELECTRICAL CONNECTOR HAVING MULTIPLE PORTS OPENING TOWARD DIFFERENT DIRECTIONS

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/753,640

(22) Filed: Jan. 2, 2001

(30) Foreign Application Priority Data

Dec. 21, 2000 (TW) ..... 89222253

(51) Int. Cl.[7] ..... H01R 24/00
(52) U.S. Cl. ..... 439/631; 439/638; 439/954
(58) Field of Search ..... 439/540.1, 541.5, 439/631, 637, 638, 660, 954

(56) References Cited

U.S. PATENT DOCUMENTS 5,558,522 A * 9/1996 Dent ..... 439/65

OTHER PUBLICATIONS

IBM Technical Disclosure Bulletin vol. 39, No. 6, pp. 129–130, Jun. 1996.*

* cited by examiner

*Primary Examiner*—Khiem Nguyen
(74) *Attorney, Agent, or Firm*—Wei Te Chung

(57) ABSTRACT

An electrical connector (100) includes an insulative housing (10) defining a first slot (16) and a second slot (20) orientated along different mating directions, the mating directions differing from each other by a desired angle and a plurality of first and second contacts (12, 14) respectively received in the first and the second slots. The first contacts each have a mating portion (123, 125) parallel with a bottom face (128) of the housing. The second contacts each have a mating portion (142) perpendicular to the bottom face of the housing. A main feature of the connector is that it is engageable with mating connectors in different directions.

10 Claims, 8 Drawing Sheets

ELECTRICAL CONNECTOR HAVING MULTIPLE PORTS OPENING TOWARD DIFFERENT DIRECTIONS

BACKGROUND OF THE INVENTION

1. Field of the Invention

The present invention relates to a connector, and particularly to a connector for connecting daughter boards to a mother board.

2. Description of the Related Art

In the electronic industry, board-to-board (BtoB) connectors are designed to work in complementary pairs and are configured to electrically connect two separate printed circuit boards (PCBs) together. Such BtoB connectors are each mounted on their respective PCBs. One of the PCBs is designated a mother board, the other is designated a daughter board. The two PCBs electrically connect with each other via the interconnecting BtoB connectors.

FIG. 8 shows a first and a second conventional BtoB connectors 3', 4' respectively mounting on a first and a second printed circuit boards (PCBs) 1',2'. The first connector 3' includes an insulative housing 5' and a plurality of first contacts 6' received in the housing 5' in an up right fashion. The second connector 4' includes an insulative housing 8' and a plurality of second contacts 7' received in the housing 8' in an up right fashion. U.S. Pat. Nos. 5,842,875 and 5,041,005 disclose similar connectors.

However, such connectors provide only one mating port and can engage with complementary connectors in only one direction. These connectors are not multiple port connectors and cannot satisfy a requirement for engaging with more than one board in more than one direction. Hence, an improved electrical connector is required to overcome the disadvantages of the prior art.

SUMMARY OF THE INVENTION

A first object of the present invention is to provide an electrical connector having multiple ports opening in different directions for engaging with mating connectors in different directions;

A second object of the present invention is to provide an electrical connector assembly including a female connector having at least two mating ports opening in different directions and at least two male connectors engageable with the female connector along the two different directions.

To fulfill the above objects, a female electrical connector of the present invention includes an insulative housing defining a first slot and a second slot respectively opening in two different directions and differing in orientation from each other by 90 degrees, and a plurality of first and second contacts respectively received in the first and the second slots. The first contacts each have a mating portion parallel with a bottom face of the housing. The second contacts each have a mating portion perpendicular to the bottom face of the housing. The connector is thus engageable with mating connectors in two different directions.

In a second embodiment, the first and the second slots differ in orientation by 45 degrees and mating portions of the first and the second contacts are angled a difference of 45 degrees from each other.

In a third alternative embodiment, the housing defines a first slot, a second slot and a third slot, the first, second and third slots each receiving respectively a plurality of first, second and third contacts therein. The second slot differs in orientation from the first slot by 90 degrees while the third slot differs in orientation from the first slot by 45 degrees.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
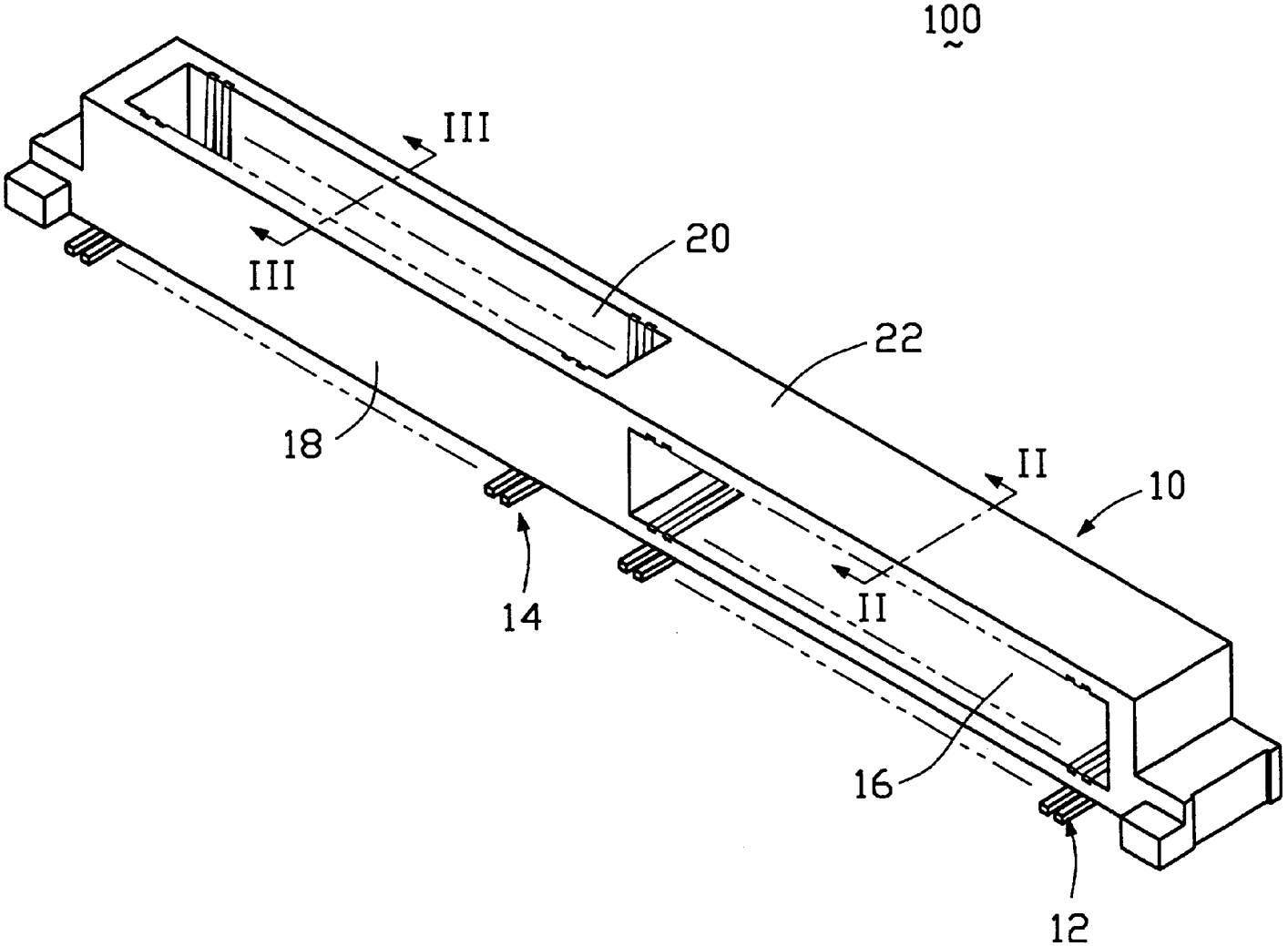
FIG. 1 is a perspective view of a female connector in accordance with a first embodiment of the present invention.

Referring to FIG. 1, an electrical connector, specifically a female connector 100 in accordance with a first embodiment of the present invention, is illustrated. The female connector 100 comprises an insulative housing 10, a plurality of first contacts 12 and a plurality of second contacts 14 retained in the housing 10. The housing 10 defines a first slot 16 in a front face 18 thereof and a second slot 20 in an upper face 22 thereof. The first and the second slots 16, 20 differ in orientation from each other by 90 degrees so that the female connector 100 is matable with corresponding mating plug connectors along two different directions separated from one another by 90 degrees.

Figure 2:
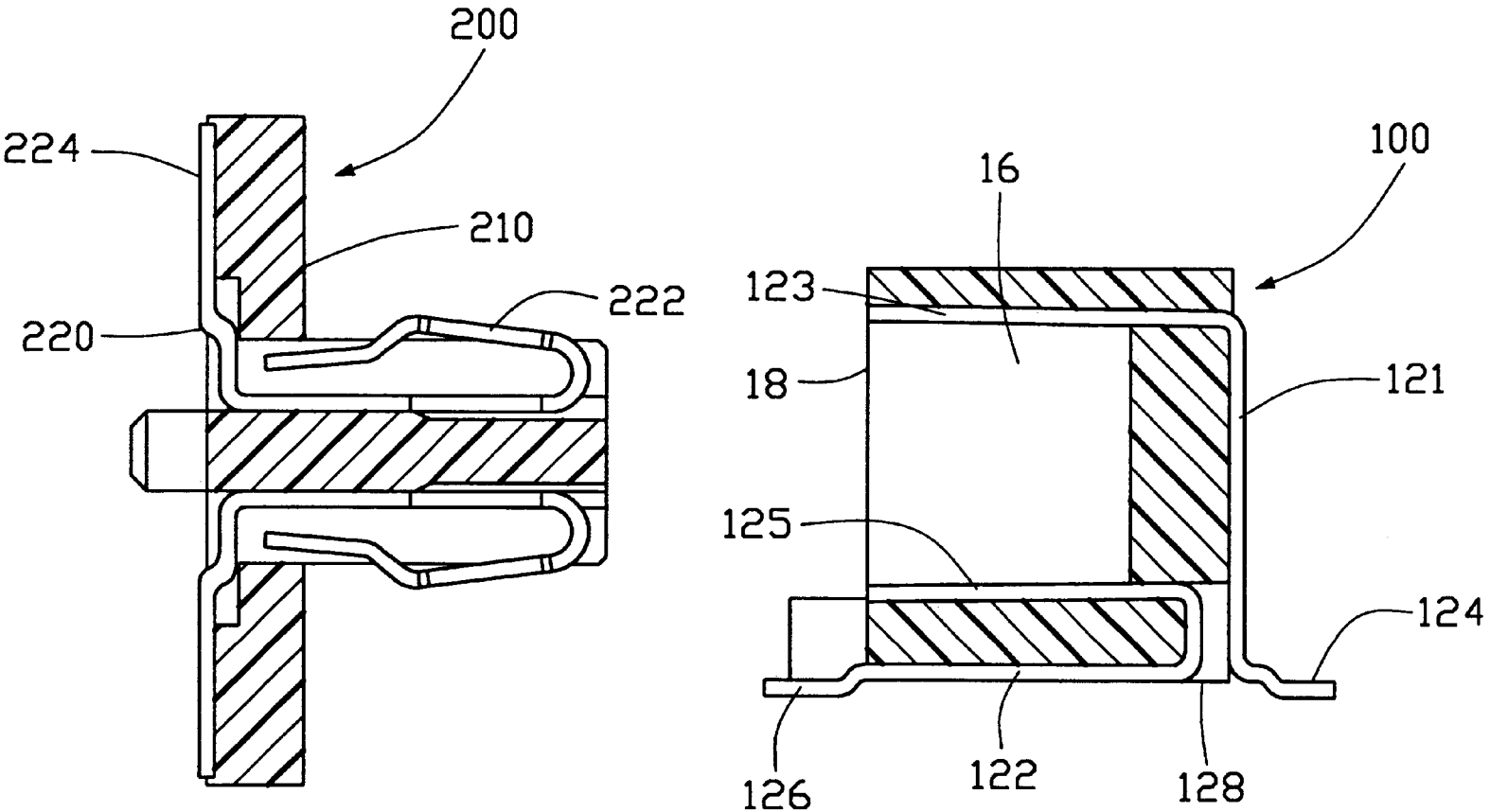
FIG. 2 is a cross-sectional view of the female connector of FIG. 1 taken along line II—II of FIG. 1, with a cross-sectioned first male connector designated to mate with the female connector.

Referring to FIG. 2 in conjunction with FIG. 1, the first contacts 12 comprise a set of upper contacts 121 and a set of lower contacts 122 respectively received in the first slot 16 of the housing 10 at upper and lower positions thereof. The upper and the lower contacts 121, 122 each respectively has a mating portion 123, 125 exposed in the first slot 16 and a solder tail 124, 126. The solder tails 126, 124 respectively extend beyond a front and a rear edges of a mounting face 128 of the housing 10 and are adapted for mounting to a first printed circuit board (not shown). The mating portions 123, 125 are generally parallel to the mounting face 128.

Figure 3:
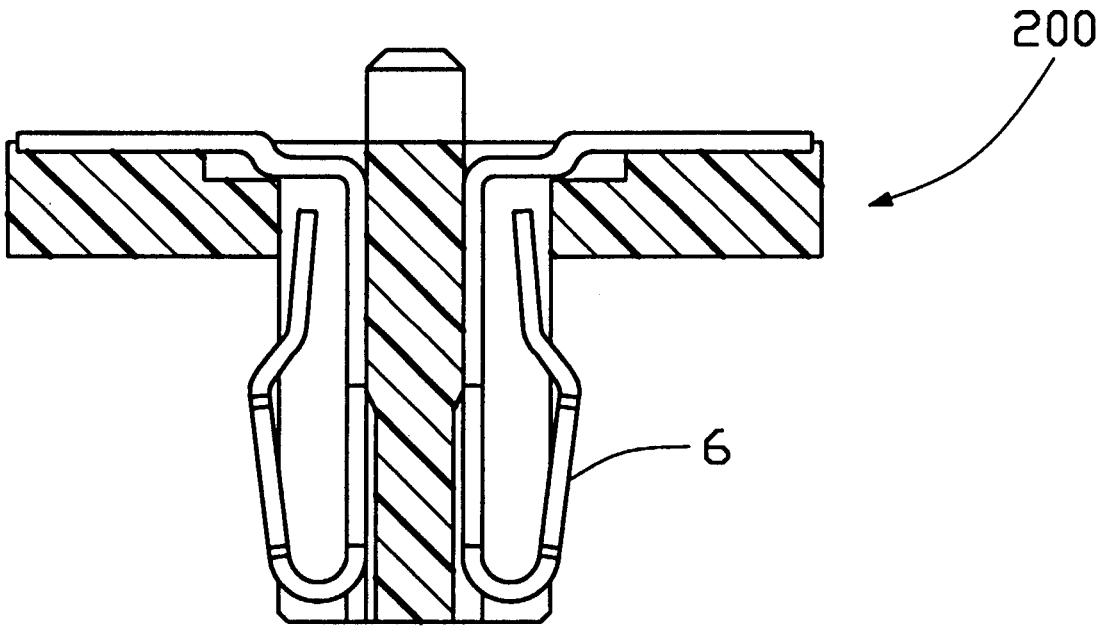
FIG. 3 is a cross-sectional view of the female connector of FIG. 1 taken along line III—III of FIG. 1, with a cross-sectioned male connector designated to mate with the female connector.
Figure 3:
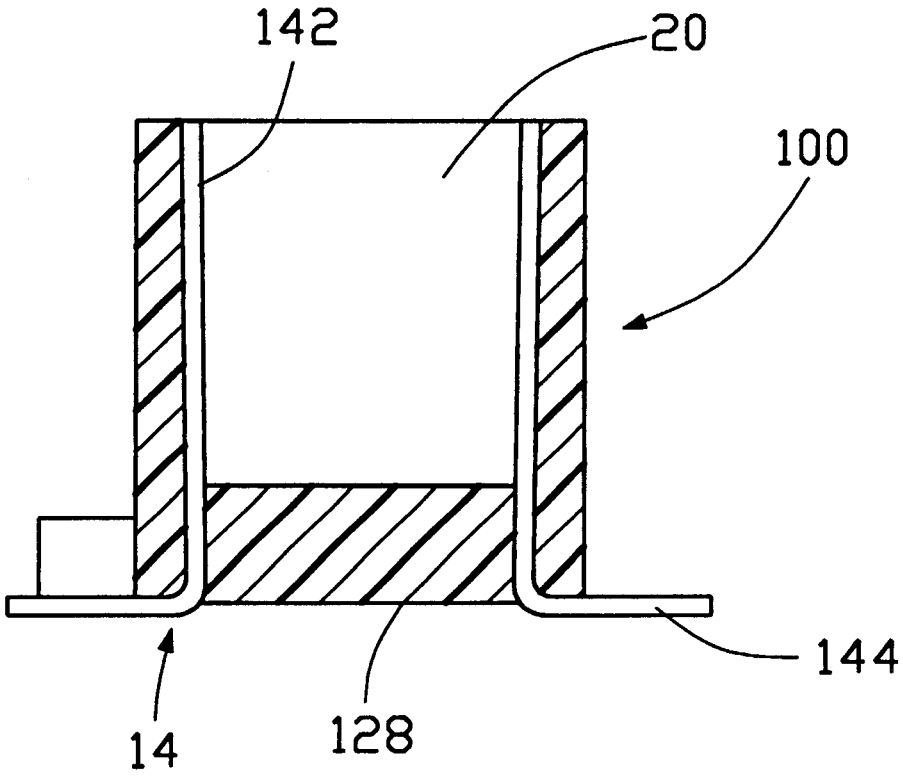

Referring to FIG. 3 in conjunction with FIG. 1, the second contacts 14 are accommodated in the second slot 20 in an upright fashion. Each second contact 14 has a mating portion 142 exposed in the second slot 20 and a solder tail 144 extending from the front and the rear edges of the mounting face 128 of the housing 10 and adapted for mounting to a first printed circuit board (not shown). The mating portions 142 are generally perpendicular to the mounting face 128.

Therefore, a 90 degree angle separates the orientation of the mating portions 123, 125 from the mating portions 142.

As is shown in FIGS. 2 & 3, a first male connector 200 and a second male connector 300 are designated to be engageably insertable into the first and the second slots 16, 20 of the housing 10, one being insertable horizontally and one being insertable downwardly. The first male connector 200 comprises a first insulative housing 210 and a plurality of first terminals 220 retained in the first housing 210. Each first terminal 220 has a mating portion 222 and a mounting portion 224 respectively adapted for engaging with the first contacts 12 and for mounting to a second printed circuit board (not shown). In this embodiment, the second male connector 300 is identical to the first male connector 200, so a detailed description thereof is omitted herein.

Figure 4:
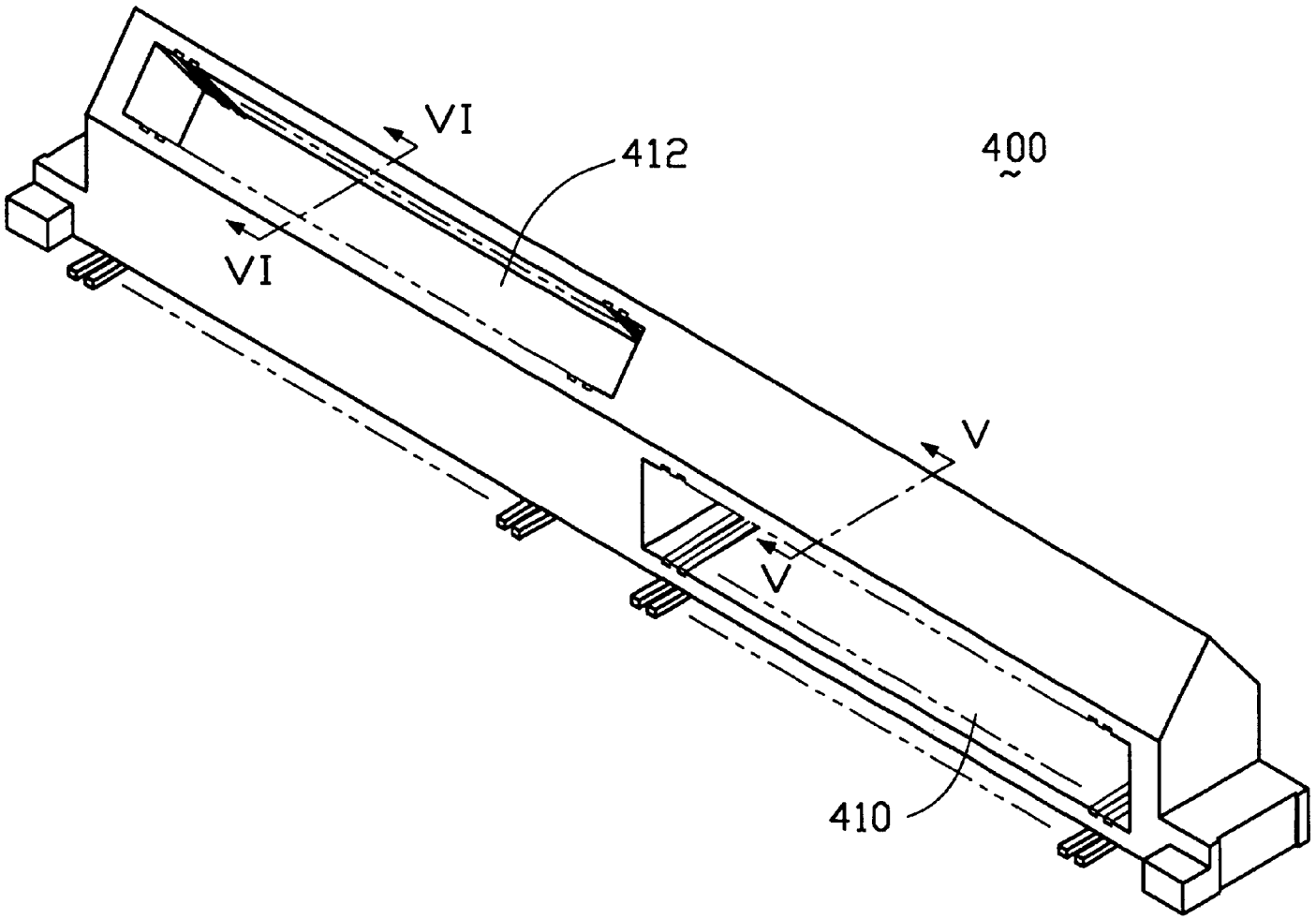
FIG. 4 is a perspective view of a female connector in accordance with a second embodiment of the present invention.
Figure 5:
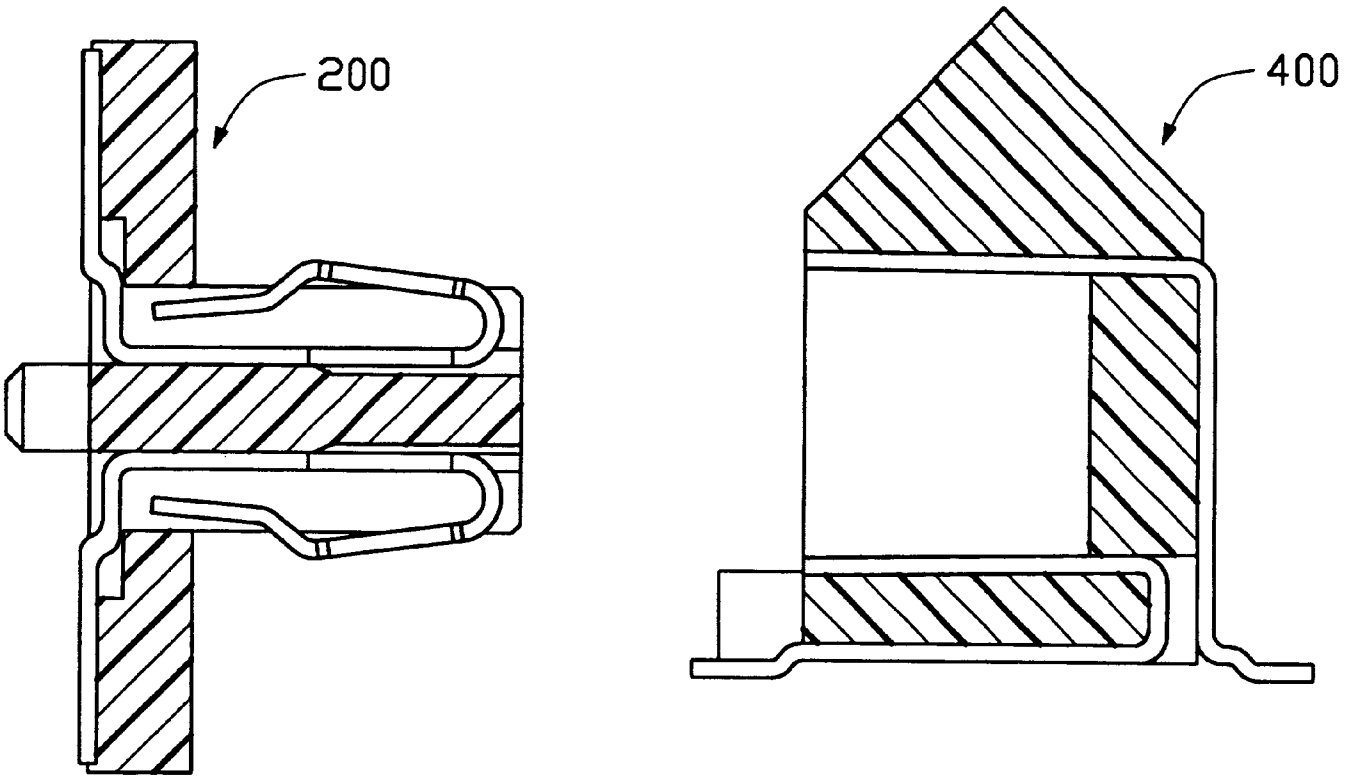
FIG. 5 is a cross-sectional view of the female connector of FIG. 4 taken along line V—V of FIG. 4, with the male connector of FIG. 2 oriented to mate with the female connector.
Figure 6:
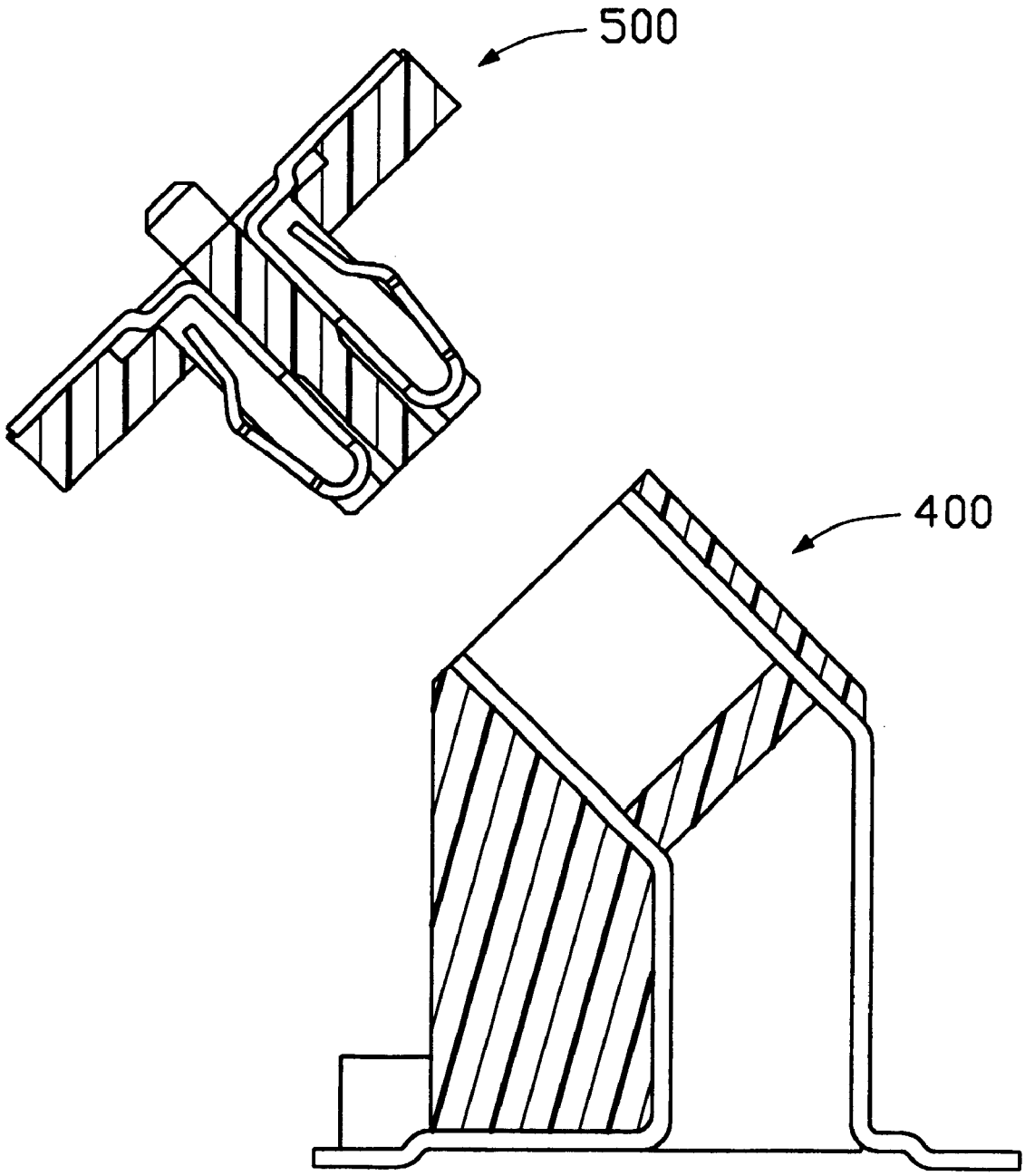
FIG. 6 is a cross-sectional view of the female connector of FIG. 4 taken along line VI—VI of FIG. 4, with a third male connector oriented to mate with the female connector.

Referring to FIGS. 4–6, a second embodiment of the present invention is illustrated. A female connector, designated by 400, is generally similar to that of the first embodiment, except that two slots 410, 412 defined therein differ in orientation from each other by about 45 degrees, and a top portion thereof is generally roof-shaped. The female connector 400 is adapted for mating with the first male connector 200 horizontally and a third male connector 500 obliquely.

Figure 7:
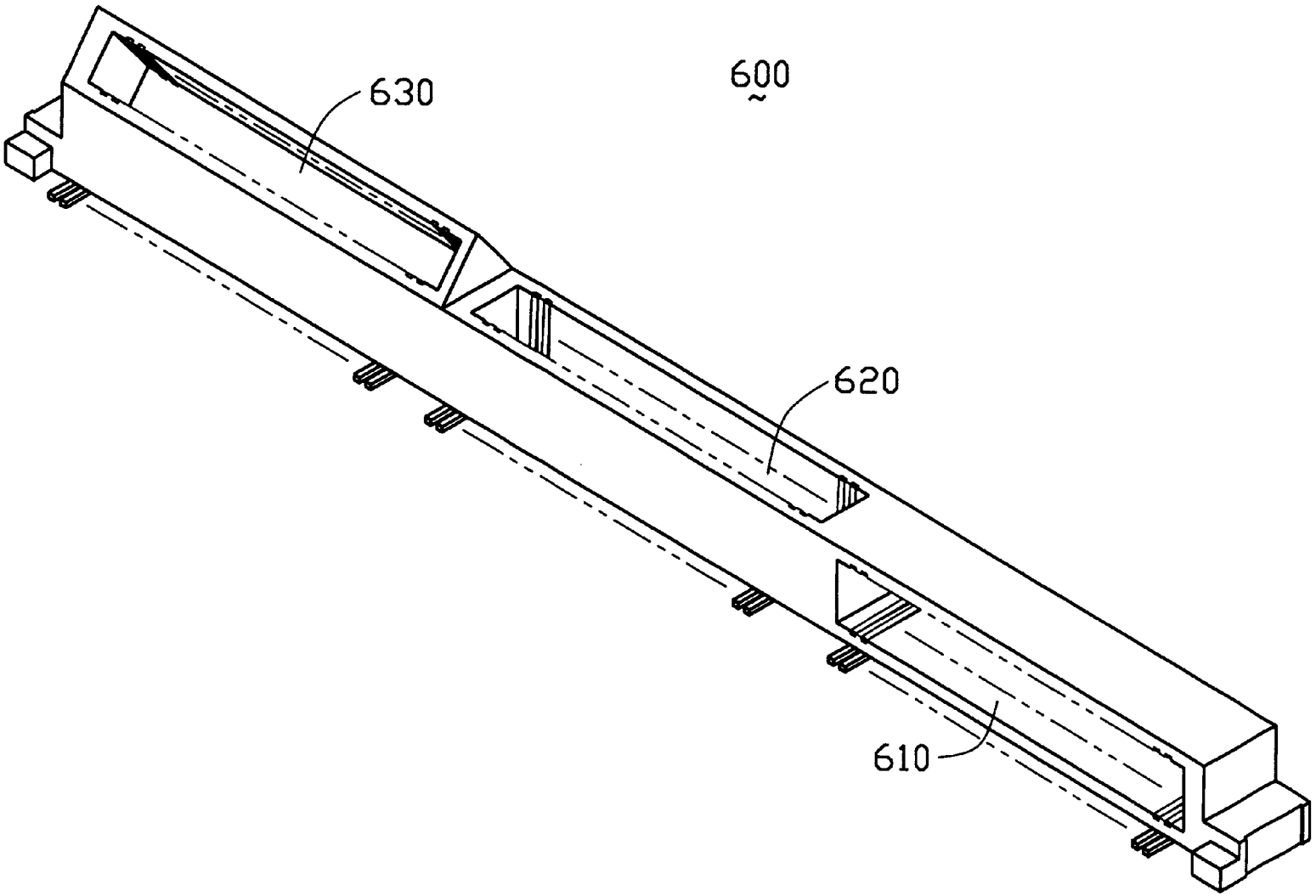
FIG. 7 is a perspective view of a female connector in accordance with a third embodiment of the present invention.
Figure 8:
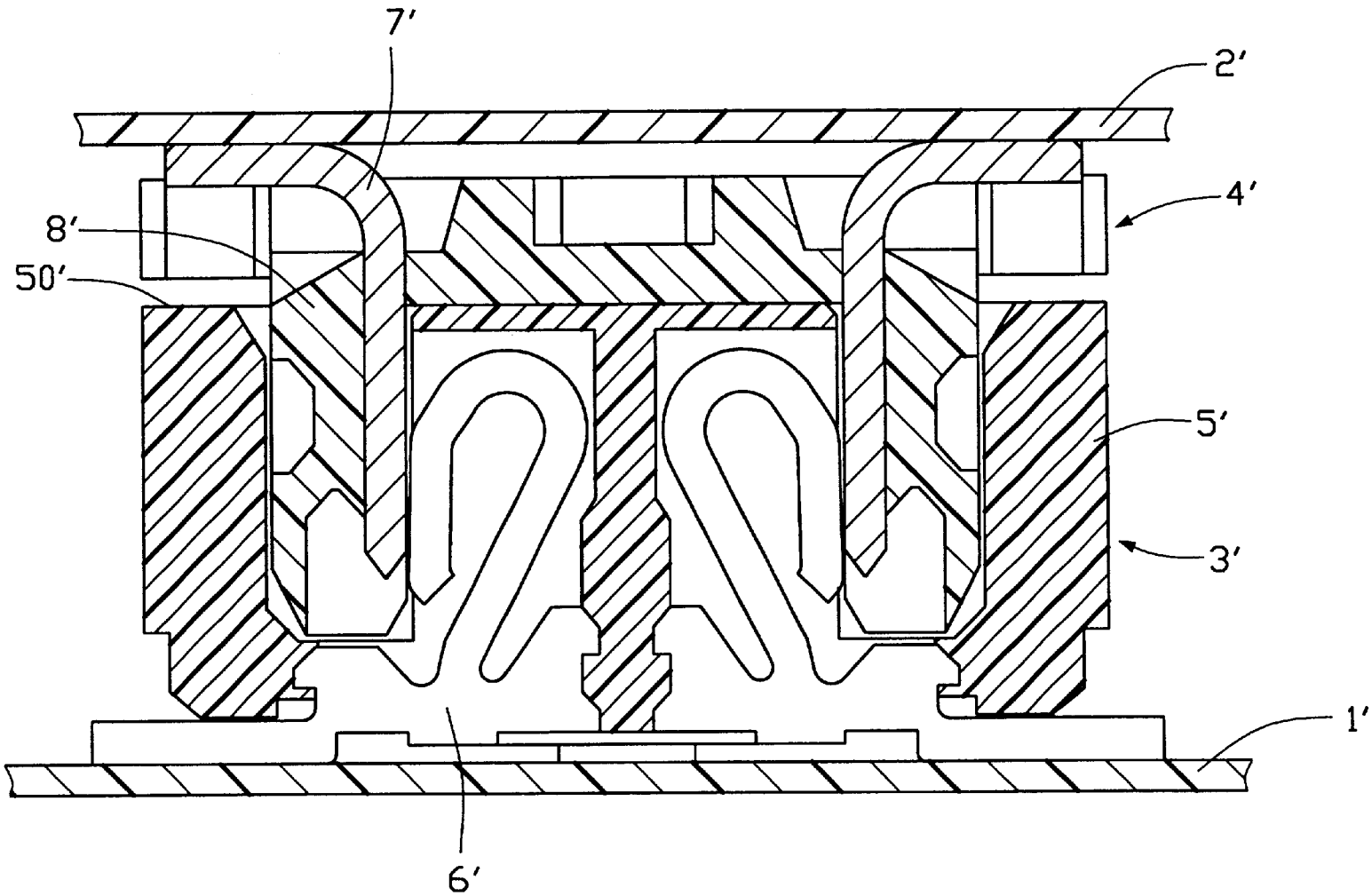
FIG. 8 (PRIOR ART)
FIG. 8 is a cross-sectional view of a pair of conventional board to board connectors mated with each other.

Referring to FIG. 7, a third embodiment of the present invention is illustrated. A female connector of the third embodiment, designated by 600, defines three slots 610, 620 and 630 in a manner as disclosed in the first and the second embodiments.

The above embodiments disclose the female connectors having slots orientation at a fixed angle of 0 degree, 45 degrees and 90 degrees. However, any other angles, for example, 30 degrees, 60 degrees, 120 degrees, 135 degrees, 150 degrees and 180 degrees, if desired, are also applicable to the female connector of the present invention, thereby still falling within the scope of the instant disclosure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining at least a first slot and a second slot differing in mating direction from each other;

two rows of first contacts received in the first slot of the housing with solder tails thereof extending beyond a bottom face of the housing for mounting to a printed circuit board; and two rows of second contacts received in the second slot of the housing with solder tails thereof extending beyond the bottom face of the housing for mounting to the printed circuit board;

the contacts in same slot being arranged in a direction along which the first and the second slots are staggered from each other.

2. The electrical connector as claimed in claim 1, wherein the first and the second slots differ in mating direction from each other by 90 degrees.

3. The electrical connector as claimed in claim 2, wherein the first contacts each has a mating portion in the first slot which is generally parallel to the bottom face of the housing, and wherein the second contacts each has a mating portion in the second slot which is generally perpendicular to the bottom face of the housing.

4. The electrical connector as claimed in claim 1, wherein the first and the second slots differ in mating direction from each other by 45 degrees.

5. The electrical connector as claimed in claim 2, wherein the housing further defines a third slot which differs in mating direction from the first slot by 45 degrees.

6. An electrical connector assembly, comprising:

a female connector including an elongate insulative housing and a plurality of contacts retained in the housing along a longitudinal direction of the insulative housing, the insulative housing defining at least two slots differing in mating direction from each other by a predetermined angle, the slots being staggered from each other in the longitudinal direction of the insulative housing and each receiving a predetermined number of the plurality of contacts therein; and at least two male connectors each including an insulative housing and a plurality of terminals retained in the housing, the male connectors being engageably received in corresponding slots of the female connectors in directions differing from each other by the predetermined angle.

7. An electrical connector comprising:

an elongated insulative housing defining front and rear faces thereof, and further defining first and second mating ports offset from each other along a longitudinal direction thereof, the first and second mating ports facing in different mating directions;

a plurality of first contacts disposed in the first mating port; and a plurality of second contacts disposed in the second mating port; wherein both solder tails of the first contacts and those of the second contacts extend outwardly out of said front and said rear faces of the housing.

8. The connector as claimed in claim 7, wherein said housing further defines a third mating ports, along said longitudinal direction, with a plurality of third contacts therein, said third mating port facing in a third mating direction which is different from both the first and the second mating direction, solder tails of the third contacts extending outwardly out of the front and the rear faces of the housing similar to those of said first and second contacts.

9. An electrical connector comprising:

an insulative housing defining at least a first slot and a second slot differing in mating direction from each other;

a plurality of first contacts received in the first slot of the housing with solder tails thereof extending beyond a bottom face of the housing for mounting to a printed circuit board; and a plurality of second contacts received in the second slot of the housing with solder tails thereof extending beyond the bottom face of the housing for mounting to the printed circuit board; wherein the first and the second slots differ in the mating direction from each other by 45 degrees; and wherein the first contacts each have a mating portion in the first slot which is generally parallel to the bottom face of the housing, and wherein the second contacts each have a mating portion in the second slot which is generally canted at an angle of 45 degrees relative to the mating portions of the first contacts.

10. An electrical connector comprising:

an insulative housing defining at least a first slot and a second slot differing in mating direction from each other;

a plurality of first contacts received in the first slot of the housing with solder tails thereof extending beyond a bottom face of the housing for mounting to a printed circuit board; and a plurality of second contacts received in the second slot of the housing with solder tails thereof extending beyond the bottom face of the housing for mounting to the printed circuit board; wherein the first and the second slots differ in the mating direction from each other by 90 degrees; and wherein the housing further defines a third slot which differs in the mating direction from the first slot by 45 degrees; and wherein the connector further includes a plurality of third contacts, each third contact having a mating portion differing in mating direction from the mating portion of the first contact by 45 degrees.

* * * * *